US006354185B1

(12) United States Patent
Sturman

(10) Patent No.: US 6,354,185 B1
(45) Date of Patent: Mar. 12, 2002

(54) FLOW MANAGER MODULE

(75) Inventor: Oded E. Sturman, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 09/336,122

(22) Filed: Jun. 17, 1999

(51) Int. Cl.[7] ..... F15B 13/04
(52) U.S. Cl. ..... 91/454; 91/464
(58) Field of Search ..... 91/6, 436, 437, 91/449, 454, 464; 137/596.18

(56) References Cited

U.S. PATENT DOCUMENTS

| | | | | |
|---|---|---|---|---|
| 3,683,239 A | | 8/1972 | Sturman | |
| 3,743,898 A | | 7/1973 | Sturman | |
| 4,409,638 A | | 10/1983 | Sturman et al. | |
| 4,857,842 A | | 8/1989 | Sturman et al. | |
| 4,870,892 A | | 10/1989 | Thomsen et al. | |
| 5,138,838 A | | 8/1992 | Crosser | |
| 5,568,759 A | | 10/1996 | Aardema | |
| 5,598,871 A | | 2/1997 | Sturman et al. | |
| 5,640,987 A | * | 6/1997 | Sturman | 137/1 |
| 5,664,477 A | | 9/1997 | Koehler | |
| 5,720,261 A | | 2/1998 | Sturman et al. | |
| 5,743,165 A | * | 4/1998 | Tanaka et al. | 91/419 |
| 5,813,226 A | | 9/1998 | Krone et al. | |
| 5,868,059 A | * | 2/1999 | Smith | 91/454 |
| 5,960,695 A | | 10/1999 | Aardema et al. | |
| 5,979,498 A | * | 11/1999 | Zenker et al. | 137/596.15 |
| 6,109,284 A | | 8/2000 | Johnson et al. | |

FOREIGN PATENT DOCUMENTS

DE 2527330 A1 * 1/1977

OTHER PUBLICATIONS

"Application of Unified Predictive Control to On/Off Control of Hydraulic System Driven by Fast–Switching Solenoid Valves", Jeronymo et al., JSME International Journal, Series C, vol. 39, No. 3, pp. 515–520, 1996.

"Programmable Electrohydraulic Valve", Book et al., SAE Paper Offer 99F–10, 1998.

SAE Paper No. 981029, "Adaptive Lift Control for a Camless Electrohydraulic Valvetrain", Anderson et al., Int'l Congress and Exposition, Detroit, MI, Feb. 23–26, 1998.

SAE Paper No. 1999–01–0825, "Digital Valve Technology Applied to the Control of an Hydraulic Valve Actuator", Misovec et al., Int'l Congress & Exposition, Detroit, MI, Mar. 1–4, 1999.

"Advanced Control System Design", by Bernard Friedland, published 1996, excerpt pp. i, ii, v–viii and 129–161.

"Applied Optimal Control—Optimization, Estimation and Control", by Bryson, Jr. et al., published 1975, excerpt pp. i, ii, vii–xi, 108–117.

"Breakthrough in Digital Valves", reprint, Machine Design, Feb. 21, 1994.

"Developments in Digital Valve Technology", by Rob Wilson, reprint, Diesel Progress North American Edition, Apr. 1997.

"The Swing to Cleaner, Smarter, Hydraulics", by Stuart Brown, excerpt pp. 152(A)(F)(J)(K), Fortune, Jun. 9, 1997.

"Vickers Taking Closer Aim at Mobile Markets", by Mike Brezonick, reprint, Diesel Progress North American Edition, Aug. 1997.

* cited by examiner

*Primary Examiner*—Edward K. Look
*Assistant Examiner*—Thomas E. Lazo
(74) *Attorney, Agent, or Firm*—Blakely, Sokoloff, Taylor & Zafman LLP

(57) ABSTRACT

A fluid control module that can control the flow of fluid between a rail line, a drain line, a first cylinder line and a second cylinder line. The control module includes a plurality of fluid-driven valves that can couple the cylinder lines to the rail and drain lines. Each fluid-driven valve is controlled by a control valve. The module may be actuated into one of a plurality of different states.

16 Claims, 3 Drawing Sheets

FIG. 1
PRIOR ART
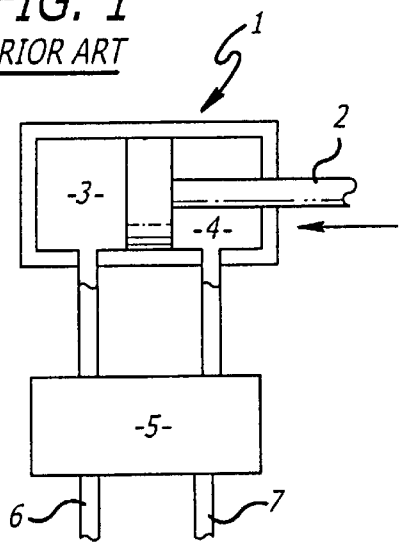
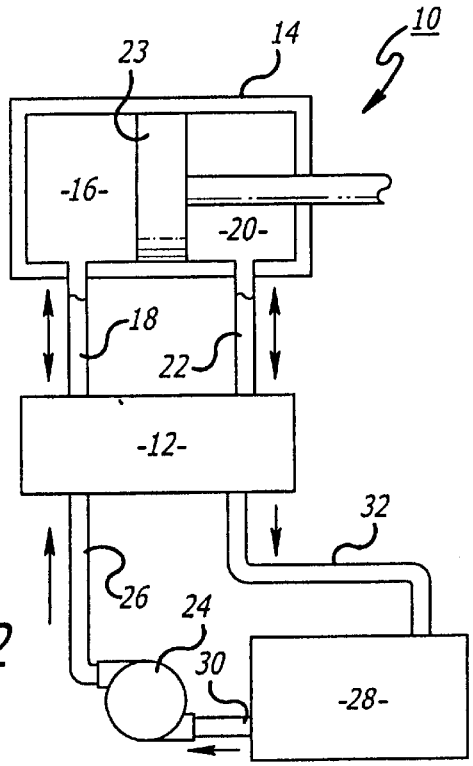
FIG. 2
FIG. 3
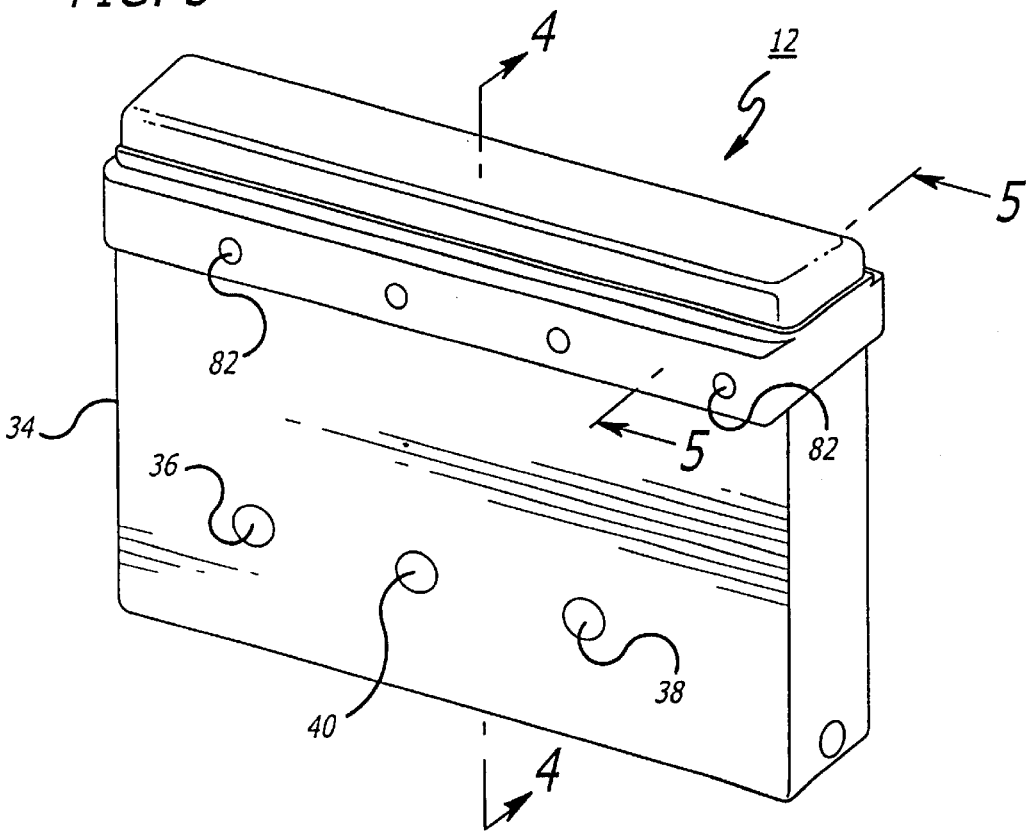

FLOW MANAGER MODULE

BACKGROUND OF THE INVENTION

1. Field of the Invention

The present invention relates to a fluid control module that controls the flow of fluid to a device such as a hydraulic actuator.

2. Background Information

There are many types of machines that incorporate hydraulically-driven actuators which lift or move an object. The actuator can be integrated into a hydraulic system which has a high pressure supply line, a low pressure drain line and a control valve that controls the flow of hydraulic fluid between the actuator, the supply line and the drain.

FIG. 1 shows an actuator or double-acting hydraulic cylinder 1 which has a piston 2 that separates a first cylinder chamber 3 from a second cylinder chamber 4. The piston 2 can move in either one of two directions, depending upon whether pressurized fluid is provided to the first cylinder chamber 3 or the second cylinder chamber 4. As an alternative embodiment, the actuator may include a return spring (not shown) within the first cylinder chamber 3 which moves the piston in an outward direction when the second cylinder chamber is coupled to the drain line of the system.

The actuator 1 may be controlled by a control valve 5. The control valve 5 typically contains a single three-way or four way spool valve (not shown) that can couple the cylinder chambers 3 and 4 to either a supply line 6 or a drain line 7. The control valve 5 can be actuated into either one of two states. In one state, the control valve 5 couples the first cylinder chamber 3 to the drain line 7 and allows pressurized fluid to flow into the second cylinder chamber 4 to hydraulically move the piston 2. In the other state, the valve 5 couples the second cylinder chamber 4 to the drain line 7 and allows pressurized fluid to flow into the first chamber 3 to hydraulically move the piston 2 in the opposite direction.

A control valve with a single spool only has two states. When the first cylinder chamber 3 is coupled to the supply line 6, the second cylinder chamber 4 is always coupled to the drain line 7. Likewise, when the second cylinder chamber 4 is coupled to the supply line 6, the first cylinder chamber 3 is always coupled to the drain line 7. It would be desirable to provide a control module that can provide more than two states. For example, it may be desirable to provide pressurized fluid to both cylinder chambers 3 and 4 to hold the position of the piston 2.

SUMMARY OF THE INVENTION

One embodiment of the present invention is a fluid control module that can control the flow of fluid between a rail line, a drain line, a first cylinder line and a second cylinder line. The module includes a plurality of fluid-driven valves that can couple the cylinder lines to the rail and drain lines. Each fluid-driven valve is controlled by a control valve. The module may be actuated into at least one a plurality of different states.

BRIEF DESCRIPTION OF THE DRAWINGS

FIG. 1 is a schematic of an embodiment of an actuator and control valve of the prior art;

FIG. 2 is a schematic of an embodiment of a hydraulic system of the present invention;

FIG. 3 is a perspective view of a control module of the hydraulic system of FIG. 2;

DETAILED DESCRIPTION

Figure 4:
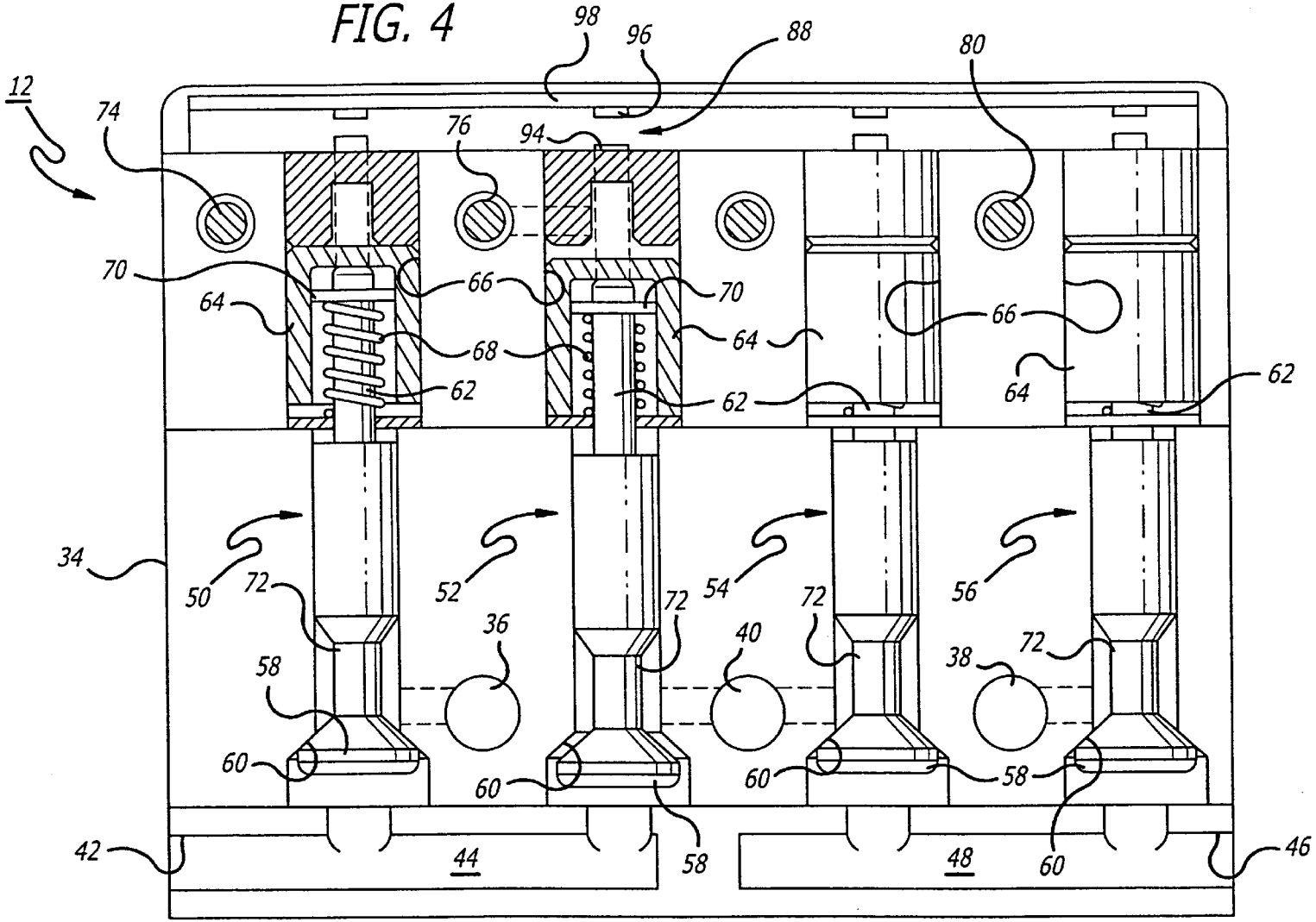
FIG. 4 is a cross-sectional view of the control module taken at line 4—4 of FIG. 3.

Referring to the drawings more particularly by reference numbers, FIG. 2 shows an exemplary embodiment of a hydraulic system 10 of the present invention. The system 10 includes a control module 12 that controls the flow of a fluid, such as air or hydraulic oil, to and from a device such as an actuator or double-acting hydraulic or pneumatic cylinder 14. The actuator 14 control includes a first chamber 16 that is connected to the control module 12 by a first cylinder line 18 and a second cylinder chamber 20 that is connected to the control module 12 by a second cylinder line 22. The cylinder chambers 16 and 20 are separated by a reciprocal or otherwise movable piston 23.

The system 10 includes a fluid pump 24 that is connected to the control module 12 by a rail line 26. The pump 24 provides pressurized fluid, such as air or hydraulic oil, to either cylinder chamber 16 or 20 of the actuator 14. The system 10 further includes a fluid reservoir 28 that is connected to the pump 24 by a supply line 30, and to the control module 12 by a drain line 32. The supply line 30 and drain line 32 are typically at a much lower fluid pressure than the rail line 26.

Figure 5:
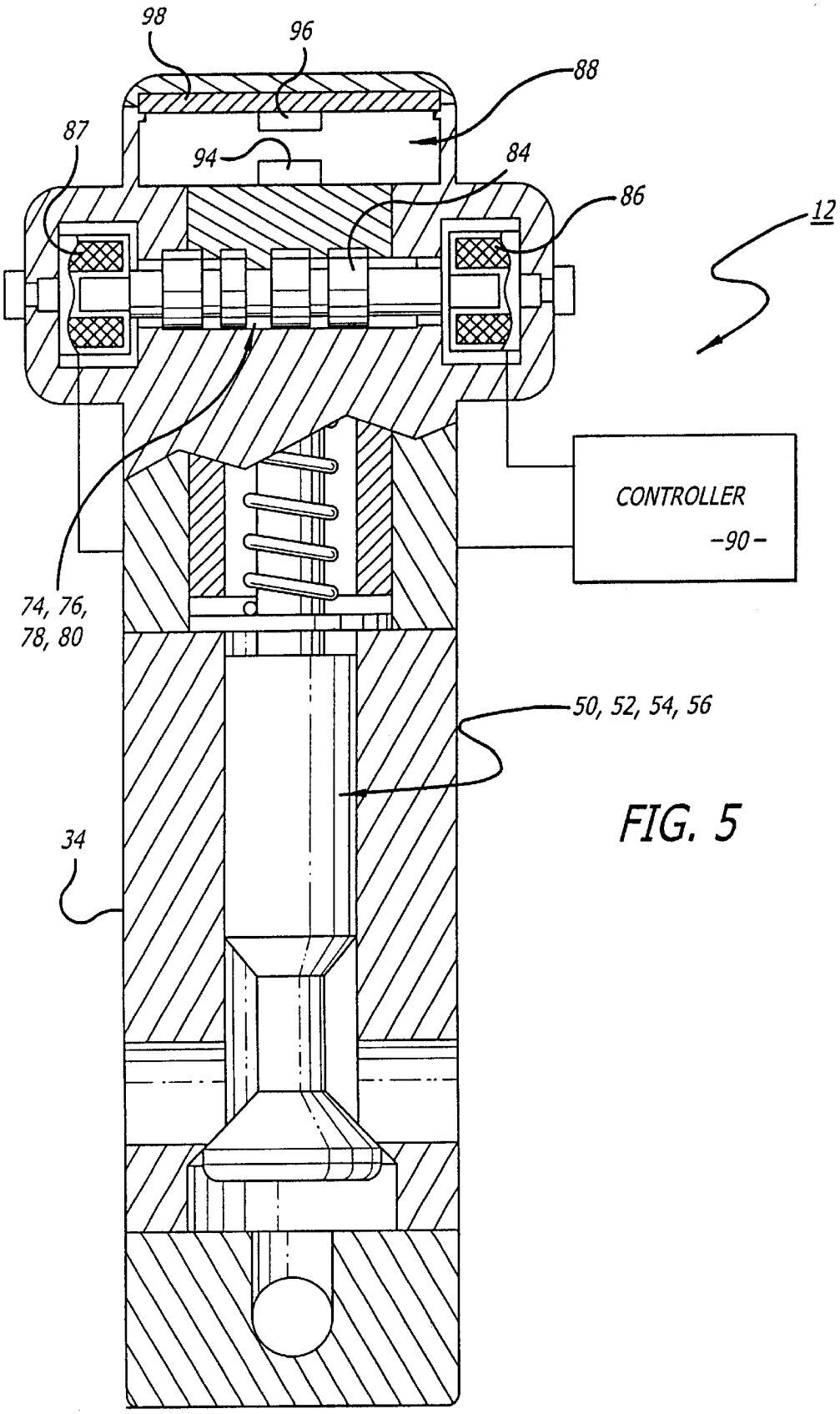
FIG. 5 is a cross-sectional view of the control module taken at line 5—5 of FIG. 3.

FIGS. 3, 4 and 5 show an exemplary embodiment of the control module 12. The control module 12 includes a housing 34 which has first 36 and second 38 drain ports that are connected to the drain line 32 shown in FIG. 2, and a rail port 40 that is connected to the rail line 26 shown in FIG. 2. The housing 34 also has a first cylinder port 42 (FIG. 4) that is connected to the first cylinder line 18 and is in fluid communication with a first internal channel 44. Likewise, the housing 34 has a second cylinder port 46 (FIG. 4) that is connected to the second cylinder line 22 and is in fluid communication with a second internal channel 48.

Referring to FIG. 4, the control module 12 contains a first hydraulically-driven or pneumatically-drive valve 50 that can control the flow of fluid from the first cylinder port 42 to the first drain port 36, and a second hydraulically-driven or pneumatically-driven valve 52 that controls the flow of fluid from the rail port 40 to the first cylinder port 42. The module 12 may also contain a third hydraulically-driven or pneumatically-driven valve 54 that controls the flow of fluid from the rail port 40 to the second cylinder port 46, and a fourth hydraulically-driven or pneumatically-driven valve 56 that controls the flow of fluid from the second cylinder port 46 to the second drain port 38.

Each fluid-driven valve 50, 52, 54 or 56 includes a valve 58 that is seated against a valve seat 60 of the housing 34 when in a closed position. The valve 58 is spaced away from the valve seat 60 when in an open position. In the open position, fluid is allowed to flow past the valve seat 60. In the closed position, the valve 58 prevents fluid flow past the valve seat 60.

Each valve 58 has a stem 62 that is coupled to a cap 64. Each cap 64 is located within a chamber 66. Pressurized fluid can be introduced into the chamber 66 to move the valve 58 to its opened position. Each stem 62 supports a return spring 68 that biases the valve 58 to its closed position when the chamber 66 is unpressurized. Each spring 68 is captured by a nut 70 that is attached to a threaded portion of the stem 62. The height of the nut 70 can be adjusted to vary the pre-load of the spring 68. Each valve 58 also has a neck portion 72 arranged in fluid communication with ports 36, 38 and 40. The neck portion 72 allows the fluid to exert equal and opposite forces on the valve 58 when in its opened position. The equal and opposite forces balance the valve 58 so that work does not have to be performed to overcome the rail fluid pressure.

The first 50, second 52, third 54 and fourth 56 fluid-driven valves are controlled by first 74, second 76,third 78 and fourth 80 control valves, respectively. The control valves 74, 76, 78 and 80 are connected to the rail line 26 and drain line 32 through control valve ports 82 (FIG. 3) in the housing 34. Each control valve 74, 76, 78 or 80 can couple the chamber 66 of each valve 50, 52, 54 or 56, respectively, to either the rail line 26 or the drain line 32. When a chamber 66 is coupled to the rail line 26, the valve 58 is moved to the open position. When the chamber 66 is coupled to the drain line 32, the valve 58 is moved to the closed position.

As shown in FIG. 5, each control valve 74, 76, 78 or 80 includes a spool valve 84 that is located between a pair of opposed electrical coils 86 and 87. The control valves 74, 76, 78 or 80 are preferably three-way valves that couple a chamber 66 to the rail line 26 when only the coil 86 is electrically energized and couple the chamber 66 to the drain line when only the coil 87 is electrically energized. The control valves 74, 76, 78 or 80 may be magnetically latched into either position with a digital pulse provided by an electrical controller 90. The valves 74, 76, 78 and 80 may be similar to the latching valves described in U.S. Pat. No. 5,640,987 issued to Sturman on Jun. 24, 1997, which is hereby incorporated by reference.

Referring to FIG. 4, the control module 12 has a plurality of position sensors 88 that can sense the position of each valve 58 and provide a feedback signal to the controller 90. The position sensors 88 may each include a magnet 94 that is connected to the cap 64 of each valve 58 and a Hall effect sensor 96 that is magnetically coupled to the magnet 94. The Hall effect sensors 96 can be mounted to a printed circuit board assembly 98 of the module 12. The controller 90 may also be mounted to the printed circuit board 98.

In operation, the controller 90 can provide signals to actuate the control valves 74, 76, 78 and 80 to open or close any one of the fluid-driven valves 50, 52, 54 or 56. The control module 12 can be driven into one of sixteen different states. For example, the first 50 and second 54 fluid-driven valves may be opened and the third 52 and fourth 56 fluid-driven valves may be closed. Table I provides a complete truth table for the possible different states of the module 10.

| Valve | 50 | 52 | 54 | 56 |
|---|---|---|---|---|
| state 1 | off | off | off | off |
| state 2 | off | off | off | on |
| state 3 | off | off | on | off |
| state 4 | off | off | on | on |
| state 5 | off | on | off | off |
| state 6 | off | on | off | on |
| state 7 | off | on | on | off |
| state 8 | off | on | on | on |
| state 9 | on | off | off | off |
| state 10 | on | off | off | on |
| state 11 | on | off | on | off |
| state 12 | on | off | on | on |
| state 13 | on | on | off | off |
| state 14 | on | on | off | on |

-continued

| Valve | 50 | 52 | 54 | 56 |
|---|---|---|---|---|
| state 15 | on | on | on | off |
| state 16 | on | on | on | on |

The valves selectively provide a variety of different fluid control or coupling states that cannot be achieved with conventional three-way and four-way valves of the prior art. For example, in state 7 above, both cylinder chambers 16 and 20 of the actuator 14 are coupled to the rail line 26. This state may maintain the position of the piston 23. States 4, 14 and 16 may couple the rail line 26 to the drain 32 to provide a by-pass function for the hydraulic system. Additionally, the latching control valves 74, 76, 78 and 80 allow the control module 12 to change states with a short digital pulse(s). There is no requirement to continuously provide electrical current to the valves 74, 76, 78 and 80, which thereby minimizes the electrical power needed to operate the control module 12.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, although four hydraulically-driven or pneumatically-driven valves 50, 52, 54, 56 are shown and described, it is to be understood that the control module 12 may have any number of such fluid-driven valves.

What is claimed is:

1. A fluid control module operable to control fluid flow between a rail line, a drain line, a first cylinder line and a second cylinder line, said control module comprising:

a housing having a plurality of ports adapted to be coupled to the rail line, the drain line, the first cylinder line and the second cylinder line;

a first fluid-driven valve located within said housing and adapted to control a flow of fluid between the drain line and the first cylinder line;

a second fluid-driven valve located within said housing and adapted to control a flow of fluid between the rail line and the first cylinder line;

a third fluid-driven valve located within said housing and adapted to control a flow of fluid between the rail line and the second cylinder line;

a fourth fluid-driven valve located within said housing and adapted to control a flow of fluid between the drain line and said second cylinder line;

a first control valve operable to control said first fluid-driven valve;

a second control valve operable to control said second fluid-driven valve;

a third control valve operable to control said third fluid-driven valve;

a fourth control valve operable to control said fourth fluid-driven valve;

a controller that is connected to said first, second, third and fourth control valves; and a plurality of position sensors coupled to said first, second, third and fourth fluid-driven valves and said controller.

2. The control module of claim 1, wherein said first, second, third and fourth control valves each include a spool valve that is coupled to a pair of electrical coils and is magnetically latchable into one of two positions by a digital pulse from said controller.

3. The control module of claim 1, wherein said first, second, third and fourth fluid-driven valves are each movable between an opened position and a closed position.

4. The control module of claim 1, wherein said housing includes a first drain port coupled to said first fluid-driven valve, a second drain port coupled to said fourth fluid-driven valve, and a rail port coupled to said second and third fluid-driven valves.

5. The module of claim 1, wherein said first, second, third and fourth hydraulically-driven valves each include a return spring.

6. The control module of claim 1, wherein said first, second, third and fourth fluid-driven valves are hydraulically driven.

7. The control module of claim 1, wherein said first, second, third and fourth fluid-driven valves are pneumatically driven.

8. A hydraulic fluid system, comprising:

an actuator having a first cylinder chamber and a second cylinder chamber;

a fluid pump;

a rail line coupled to said pump;

a drain line coupled to said pump;

a housing coupled to said first cylinder chamber, said second cylinder chamber, said rail line, and said drain line;

a first hydraulically-driven valve located within said housing and adapted to control a flow of fluid between said drain line and said first cylinder chamber;

a second hydraulically-driven valve located within said housing and adapted to control a flow of fluid between said rail line and said first cylinder chamber;

a third hydraulically-driven valve located within said housing and adapted to control a flow of fluid between said rail line and said second cylinder chamber;

a fourth hydraulically-driven valve located within said housing and adapted to control a flow of fluid between said drain line and said second cylinder chamber;

a first control valve operable to control said first hydraulically-driven valve;

a second control valve operable to control said second hydraulically-driven valve;

a third control valve operable to control said third hydraulically-driven valve;

a fourth control valve operable to control said fourth hydraulically-driven valve;

a controller connected to said first second, third and fourth control valves; and a plurality of position sensors coupled to said first, second, third and fourth hydraulically-driven valves and said controller.

9. The fluid system of claim 8, wherein said first, second, third and fourth control valves each include a spool valve coupled to a pair of electrical coils and is magnetically latchable into one of two positions by a digital pulse from said controller.

10. The fluid system of claim 8, wherein said first, second, third and fourth hydraulically-driven valves are each movable between an open position and a closed position.

11. The fluid system of claim 8, wherein said housing includes a first drain port coupled to said first hydraulically-driven valve, a second drain port coupled to said fourth hydraulically-driven valve, and a rail port coupled to said second and third hydraulically-driven valves.

12. The fluid system of claim 8, wherein said first, second, third and fourth hydraulically-driven valves each include a return spring.

13. A method for controlling the flow of fluid between a rail line, a drain line, a first cylinder line and a second cylinder line, said method comprising the steps of:

coupling a control module to the rail line, the drain line, the first cylinder line and the second cylinder line, the control module including a first fluid-driven valve for controlling a flow of fluid between the drain line and the first cylinder line, a second fluid-driven valve for controlling a flow of fluid between the rail line and the first cylinder line, a third fluid-driven valve for controlling a flow of fluid between the rail line and the second cylinder line, a fourth fluid-driven valve for controlling a flow of fluid between the drain line and said second cylinder line, a first control valve for controlling said first fluid-driven valve, a second control valve for controlling said second fluid-driven valve, a third control valve for controlling said third fluid-driven valve, a fourth control valve for controlling said fourth fluid-driven valve, a controller for controlling said first, second, third and fourth control valves, and a plurality of position sensors coupled to said first, second, third and fourth fluid-driven valves and said controller; and, actuating the controller responsive to said plurality of position sensors to place the control module into one of 16 states with respect to the positions of said first, second, third, and fourth fluid-driven valves.

14. The method of claim 13, wherein the device includes a first cylinder chamber and a second cylinder chamber.

15. The method of claim 14, wherein one state of the control module couples the rail line to the first and second cylinder chambers.

16. The method of claim 14, wherein one state of the control module couples the first cylinder chamber to the rail line and the drain line.

* * * * *